US006152123A

United States Patent [19]

Ferrante et al.

[11] Patent Number: 6,152,123

[45] Date of Patent: Nov. 28, 2000

[54] MULTIPLE BARREL RING AIRFOIL LAUNCHER AND MULTIPLE RING CHUCK FOR A RING AIRFOIL LAUNCHER

[75] Inventors: William K. Ferrante, Vacaville; Albert R. Hughes, Fairfield, both of Calif.

[73] Assignee: OddzOn, Inc., Pawtucket, R.I.

[21] Appl. No.: 09/332,450

[22] Filed: Jun. 14, 1999

[51] Int. Cl.[7] ..... F41B 7/00

[52] U.S. Cl. ..... 124/16; 124/81

[58] Field of Search ..... 124/16, 17, 20.1, 124/81; 446/34, 48; 473/589

[56] References Cited

U.S. PATENT DOCUMENTS

| | | | |
|---|---|---|---|
| D. 279,492 | 7/1985 | Eddins et al. | D21/89 |
| D. 337,796 | 7/1993 | Sutyak | D21/145 |
| D. 360,439 | 7/1995 | Lewinski | D21/147 |
| D. 360,914 | 8/1995 | Brown | D21/147 |
| D. 361,105 | 8/1995 | Griffin | D21/147 |
| D. 368,280 | 3/1996 | Brown | D21/3 |
| 2,474,054 | 6/1949 | Jones | 124/32 |
| 2,784,711 | 3/1957 | Vaughn | 124/2 |
| 3,232,285 | 2/1966 | Rasner | 124/21 |
| 3,264,776 | 8/1966 | Morrow . | |
| 3,877,383 | 4/1975 | Flatau | 102/93 |
| 3,898,932 | 8/1975 | Flatau et al. | 102/66 |
| 3,951,070 | 4/1976 | Flatau et al. | 102/92.4 |
| 3,982,489 | 9/1976 | Flatau et al. | 102/92.4 |
| 4,003,574 | 1/1977 | MacDonald et al. | 273/65 EC |
| 4,151,674 | 5/1979 | Klahn et al. . | |
| 4,154,012 | 5/1979 | Miller . | |
| 4,246,721 | 1/1981 | Bowers . | |
| 4,291,663 | 9/1981 | Buck et al. | 124/26 |
| 4,390,148 | 6/1983 | Cudmore | 244/19 |
| 4,560,358 | 12/1985 | Adler | 446/46 |
| 4,737,128 | 4/1988 | Moormann et al. | 446/46 |
| 4,790,788 | 12/1988 | Hill | 446/61 |
| 4,820,230 | 4/1989 | Richards | 446/48 |
| 4,892,081 | 1/1990 | Moormann | 124/65 |
| 4,957,092 | 9/1990 | Rhodes | 124/20.1 |
| 5,050,575 | 9/1991 | Killion | 123/8 |
| 5,113,842 | 5/1992 | Moormann | 124/65 |
| 5,115,794 | 5/1992 | Moormann | 124/65 |
| 5,213,089 | 5/1993 | DeLuca | 124/29 |
| 5,224,464 | 7/1993 | Burnham et al. | 124/67 |
| 5,224,701 | 7/1993 | Sciarrillo et al. . | |
| 5,254,077 | 10/1993 | Nottingham et al. | 446/48 |
| 5,259,360 | 11/1993 | Panara et al. | 124/50 |
| 5,267,549 | 12/1993 | Webber | 124/65 |
| 5,377,656 | 1/1995 | Lewinski et al. | 124/65 |
| 5,397,261 | 3/1995 | Malewicki et al. | 446/71 |
| 5,438,972 | 8/1995 | Harbin | 124/27 |
| 5,447,144 | 9/1995 | Ivy | 124/26 |
| 5,531,210 | 7/1996 | Meiser et al. | 124/66 |
| 5,535,729 | 7/1996 | Griffin et al. | 124/66 |
| 5,611,322 | 3/1997 | Matsuzaki et al. | 124/6 |
| 5,655,947 | 8/1997 | Chen | 446/46 |
| 5,816,879 | 10/1998 | Kyame | 446/48 |
| 5,868,597 | 2/1999 | Chen | 446/46 |

*Primary Examiner*—John A. Ricci

*Attorney, Agent, or Firm*—Marshall, O'Toole, Gerstein, Murray & Borun

[57] ABSTRACT

A ring airfoil launcher has a first barrel and a second barrel coupled to a stock and a launching mechanism disposed within each of the first barrel and the second barrel and within the stock. A chuck for the ring airfoil launcher has a hub having an inner diameter sized to be received over either the first barrel or the second barrel and to be axially slidable along the respective barrel. The hub is arranged to be coupled to the respective launch mechanism. The chuck has a first ring airfoil engaging surface formed on the hub, the first ring airfoil engaging surface adapted to receive a first ring airfoil, and a second ring airfoil engaging surface formed on the hub, the second ring airfoil engaging surface adapted to receive a second ring airfoil.

21 Claims, 10 Drawing Sheets

MULTIPLE BARREL RING AIRFOIL LAUNCHER AND MULTIPLE RING CHUCK FOR A RING AIRFOIL LAUNCHER

BACKGROUND OF THE INVENTION

The present invention relates generally to toy projectile launchers and more particularly to a chuck for a ring airfoil launcher for the simultaneous launching of multiple ring airfoils and to a multiple barrel ring airfoil launcher.

Flying toys are and long have been favorites of children. The excitement of launching an object and watching it fly through the air continues to capture the imagination of youngsters. Being able to control and direct the flight of objects further adds to the amusement and attraction of these toys.

Ballistic type toy projectiles, such as darts, arrows, missiles and the like are common. A drawback of these toys is the inherent parabolic flight path, which limits both the distance of flight and accuracy. Toy projectiles that generate lift during flight overcome these limitations and have the ability to provide substantially level flight trajectory. Commonly assigned U.S. patent application Ser. No. 09/092,564, filed Jun. 5, 1998 and entitled "Ring Airfoil Launcher," the disclosure of which is hereby expressly incorporated herein by reference, describes a lift generating ring airfoil toy and a variety of launchers. The advantage of the ring airfoil is its ability to generate lift during flight offering the potential for substantially level flight over increased distances. Furthermore, the launchers disclosed therein are arranged to impart spin on the ring airfoil as it is launched. The spinning action enhances lift generation and gyro-stabilizes the ring airfoil on its flight path. As is appreciated, the ring airfoils and launchers disclosed in application Ser. No. 09/092,564 yield both increased flight distance and accuracy to target.

To achieve the desired flight characteristics, a ring airfoil launcher is designed to impart both rotational and translational launching energy to the ring airfoil. This creates a complex launching action requiring a complex launching mechanism. The launching mechanisms described in the application Ser. No. 09/092,564 are very effective for providing the required launching action. However, these mechanisms are limited to launching single ring airfoils at a time before requiring reloading.

SUMMARY OF THE INVENTION

A ring airfoil launcher has a barrel, a launch spring disposed within the barrel, and a rod disposed within the barrel and coupled to the launch spring. The rod is axially slidable within the barrel between a first position and a second position, wherein in the second position energy is stored in the launch spring and in the first position energy is released from the launch spring. The chuck is coupled to the rod for movement therewith and the chuck is coupled to a contoured surface formed in the barrel. The contoured surface is arranged to impart a rotational motion to the chuck. A first ring airfoil engaging surface is formed on the chuck, the first ring airfoil engaging surface being adapted to receive a first ring airfoil, and a second ring airfoil engaging surface formed on the chuck, the second ring airfoil engaging surface being adapted to receive a second ring airfoil.

A chuck for a ring airfoil launcher has a hub including an inner diameter sized to be received around a barrel of a ring airfoil launcher and to be axially slidable along the barrel. The hub is arranged to be coupled to a launch mechanism and is formed to include a first ring airfoil engaging surface, the first ring airfoil engaging surface being adapted to receive a first ring airfoil, and a second ring airfoil engaging surface, the second ring airfoil engaging surface being adapted to receive a second ring airfoil.

A ring airfoil launcher has a first barrel, a first launch spring disposed within the first barrel, and a first rod disposed within the first barrel and coupled to the first launch spring, the first rod being axially slidable within the first barrel between a first position and a second position, wherein in the second position energy is stored in the first launch spring and in the first position energy is released from the first launch spring. A first latch is arranged to engage the first rod to retain the first rod in the second position in order to retain the energy in the first launch spring. A first trigger is coupled to the first latch to release the first latch from the first rod such that the energy is released from the first launch spring and into the first rod such that the first rod is translated within the first barrel from the second position to the first position. A first chuck is coupled to the first rod for movement therewith and the first chuck is coupled to a first contoured surface formed in the first barrel. The first contoured surface is arranged to impart a rotational motion to the first chuck. A first ring airfoil engaging surface is formed on the chuck, and the first ring airfoil engaging surface is adapted to receive a first ring airfoil. The ring airfoil launcher has a second barrel, a second launch spring disposed within the second barrel and a second rod disposed within the second barrel and coupled to the second launch spring, the second rod being axially slidable within the second barrel between a first position and a second position, wherein in the second position energy is stored in the second launch spring and in the first position energy is released from the second launch spring. A second latch is arranged to engage the second rod to retain the second rod in the second position in order to retain the energy in the second launch spring. A second trigger is coupled to the second latch to release the second latch from the second rod such that the energy is released from the second launch spring and into the second rod such that the second rod is translated within the second barrel from the second position to the first position. A second chuck is coupled to the second rod for movement therewith and the second chuck is coupled to a second contoured surface formed in the second barrel. The second contoured surface is arranged to impart a rotational motion to the second chuck. A second ring airfoil engaging surface is formed on the second chuck, the second ring airfoil engaging surface is adapted to receive a second ring airfoil.

The features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
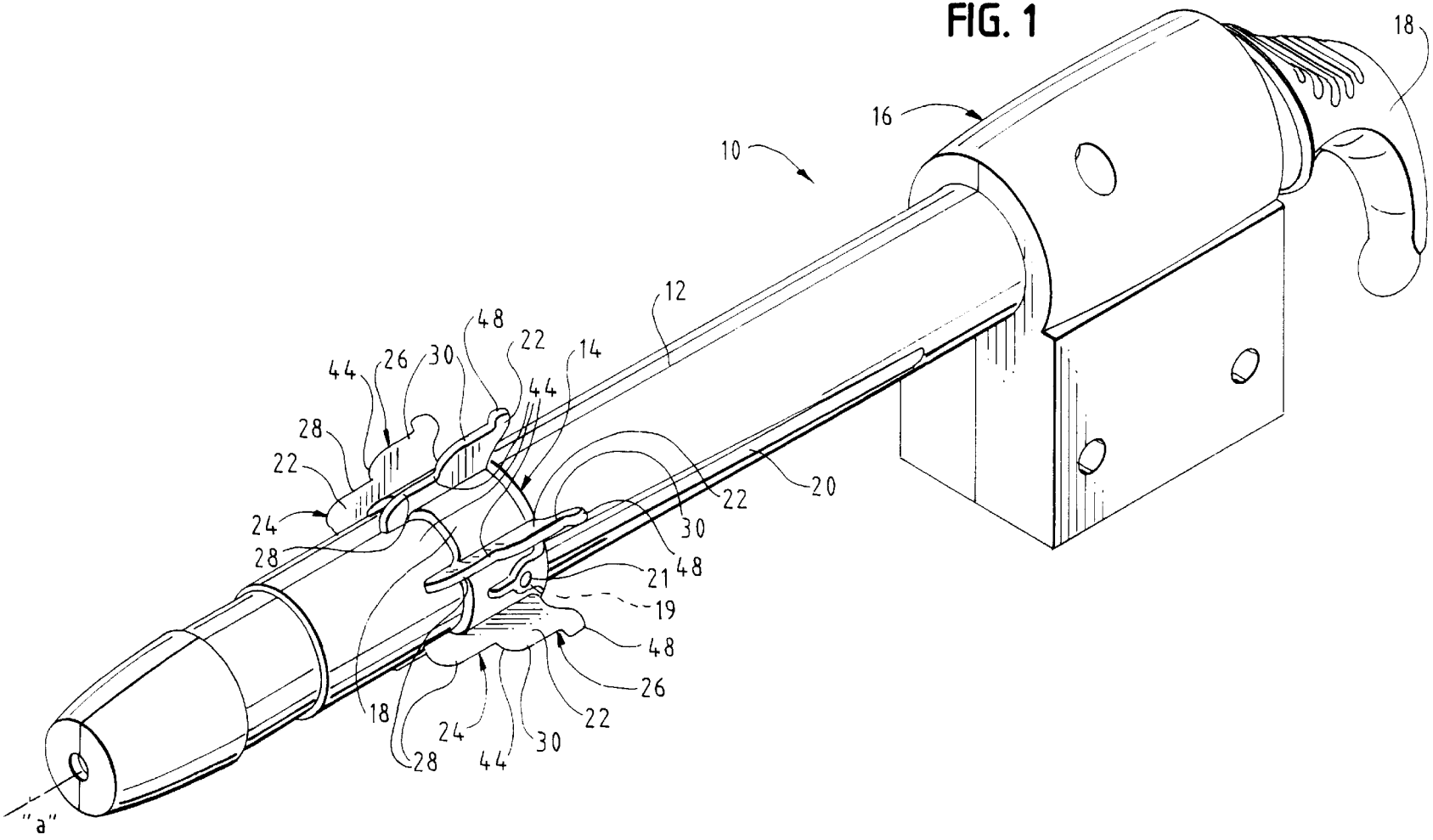
FIG. 1 is a left front perspective view of a ring airfoil launcher including a multiple ring airfoil launching chuck in accordance with a preferred embodiment of the present invention.
Figure 2:
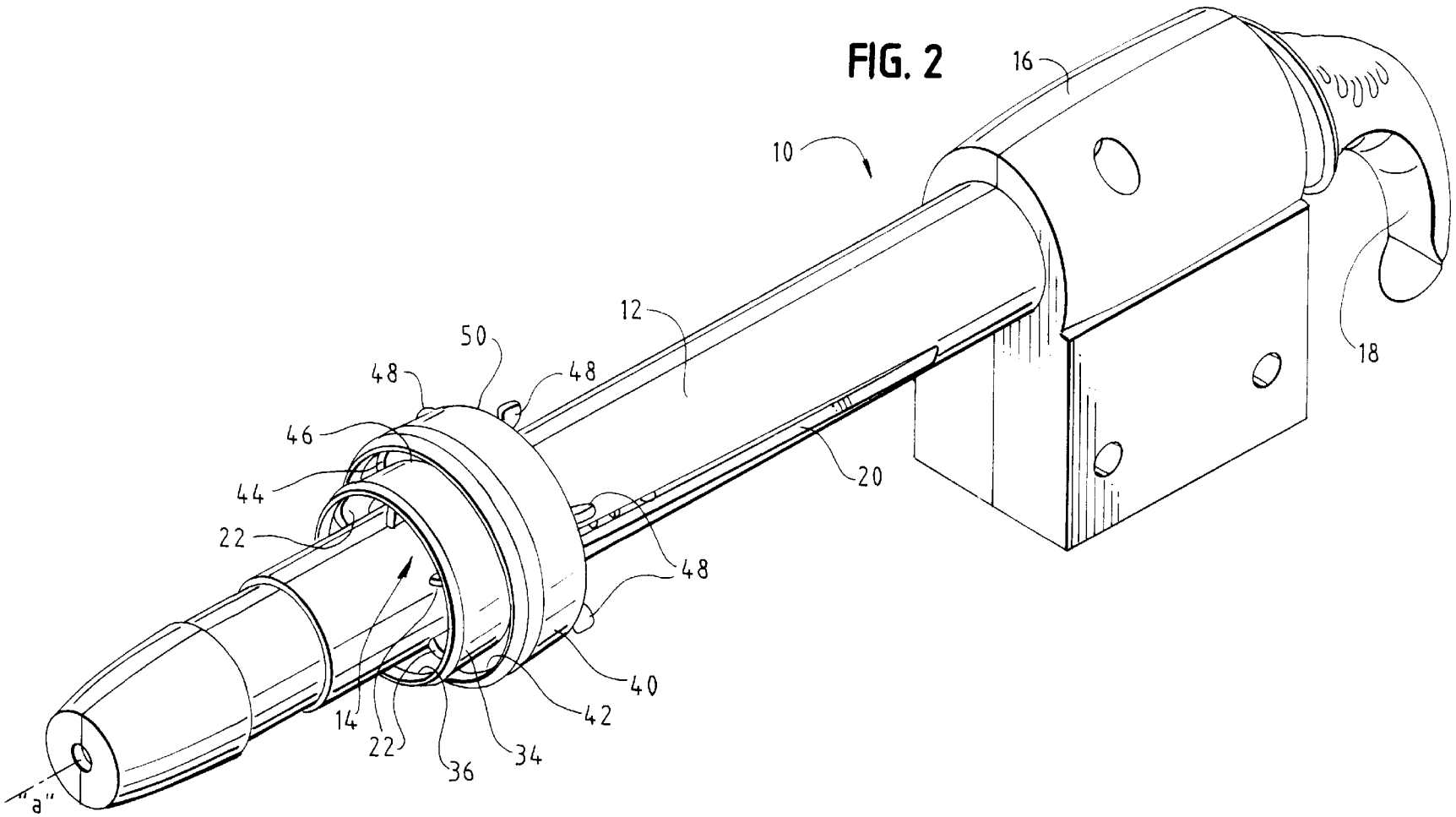
FIG. 2 is a view similar to FIG. 1 illustrating multiple ring airfoils mounted to the launching chuck.
Figure 3:
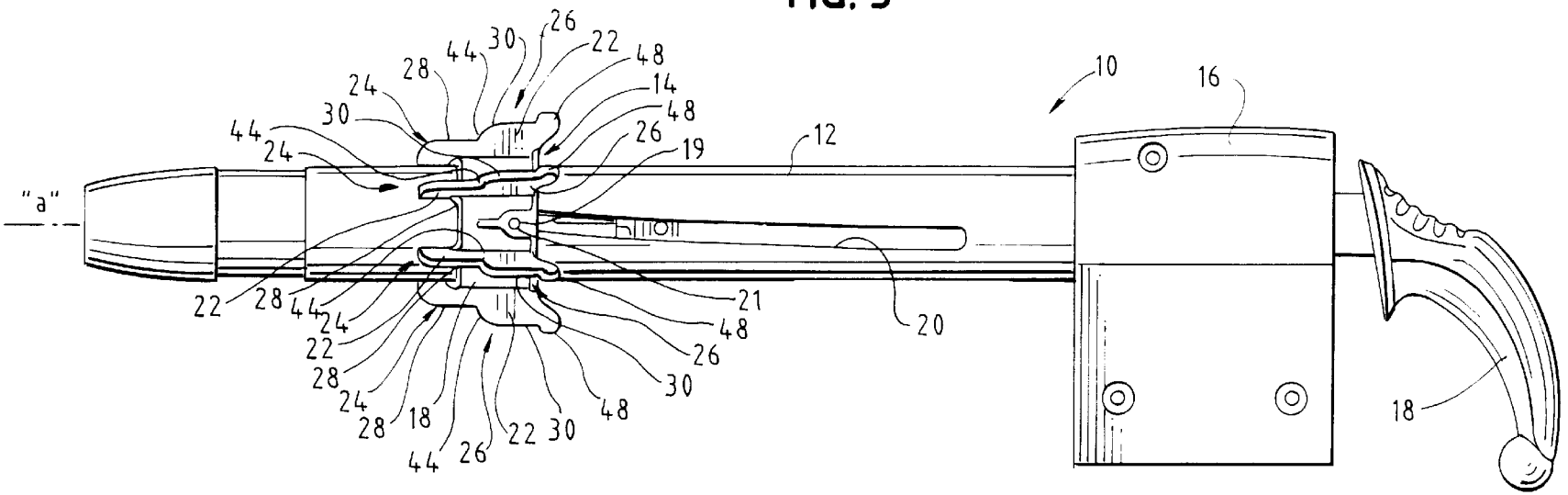
FIG. 3 is a left side view of the ring airfoil launcher shown in FIG. 1.

With reference to FIG. 1, a ring airfoil launcher 10 is arranged with a single barrel 12 fitted with a dual ring airfoil launching chuck 14. The barrel 12 extends longitudinally from a stock 16 along a launching axis "a." A launching handle 18 extends from the stock 16 opposite the barrel 12 and is coupled to a launching mechanism (not shown) disposed within the stock 16 and within barrel 12. The launching mechanism maybe as shown and described in the aforementioned and incorporated U.S. patent application Ser. No. 09/092,564.

The chuck 14 may include an annular hub 18 that is slidable and rotatable along the barrel 12. The annular hub 18 may be formed with an aperture 19 to engage a pin 21 that extends through a contoured slot 20 formed along the barrel 12. The pin 21 couples the chuck 14 to the launching mechanism disposed within the barrel 12 and the stock 16.

As is also described in application Ser. No. 09/092,564, drawing the handle 18 rearward draws the chuck 14 rearward along the barrel 12 and stores energy in a launching spring. Engagement of the pin 21 with the contoured slot 20 rotates the chuck 14 as it traverses axially along the barrel 12. Subsequent release of the handle 18 releases the energy stored in the launching spring to the chuck 14. The chuck 14 is thus propelled along the barrel 12, with the engagement of the pin 21 with the contoured slot 20 again rotating the chuck 14 as it translates along the barrel 12. In this manner translation energy and rotation is imparted to the chuck 14, and hence to ring airfoils disposed on the chuck 14.

Figure 4:
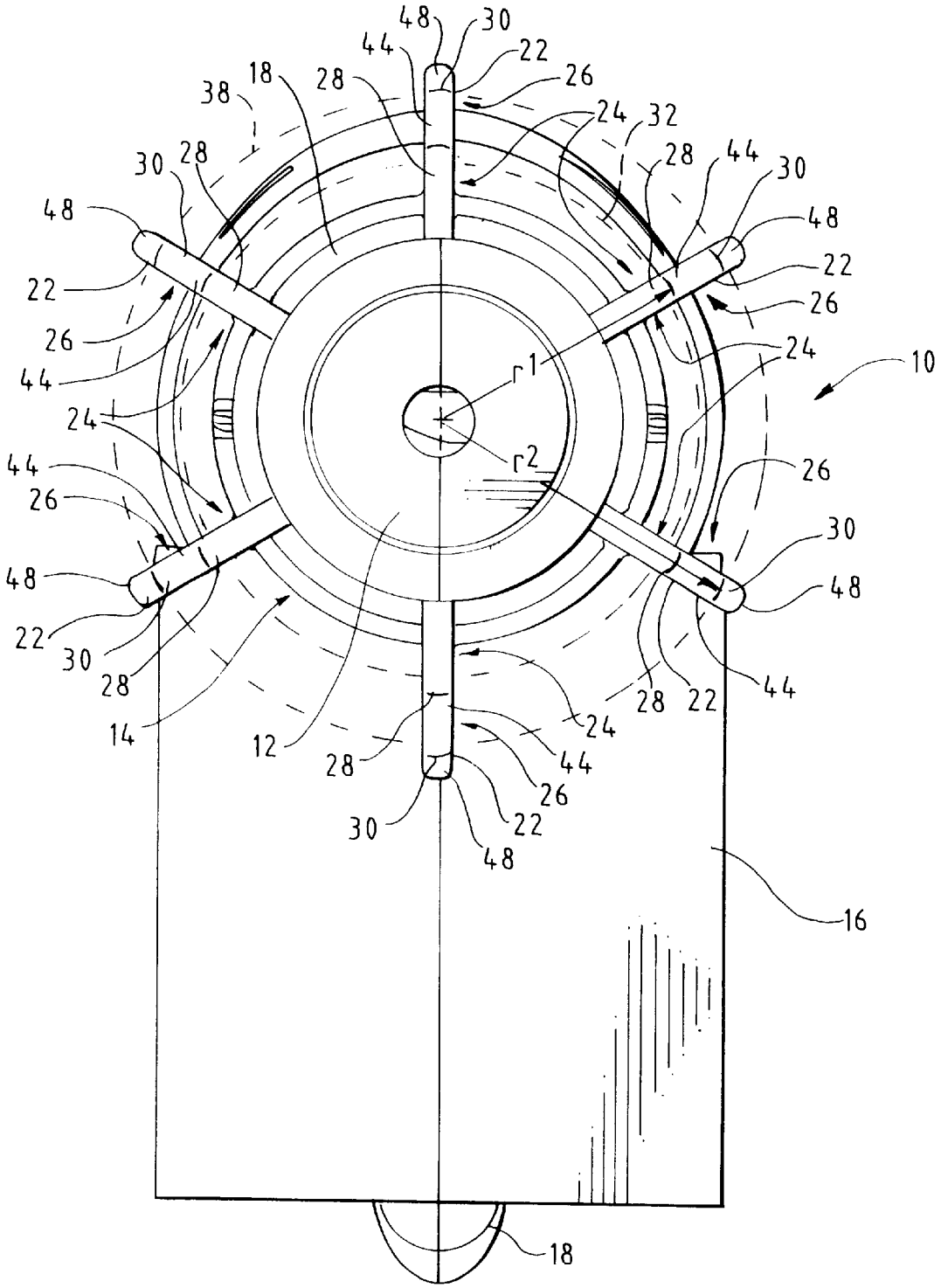
FIG. 4 is a front view of the ring airfoil launcher shown in FIG. 1.

With continued reference to FIGS. 1–4, the chuck 14 may be formed with a plurality of ribs 22 extending radially outwardly from the hub 18. Each rib 22 may be formed to include a first airfoil mounting portion 24 and a second airfoil mounting portion 26. The first airfoil mounting portion may include a first edge surface 28 extending substantially parallel with the launching axis "a" and is formed a first radial distance "r1" from a centerline of the hub 18 (FIG. 4). The second airfoil mounting portion may include a second edge surface 30 that extends substantially parallel with the launching axis "a" and is formed a second radial distance "r2" from the centerline of the hub 18.

Collectively the first edge surfaces 28 define a first ring airfoil engaging surface 32 (shown in phantom in FIG. 4), with a first diameter sized such that each first edge surface 28 engages a first ring airfoil 34 (FIG. 2) having an inner diameter 36 approximately the same or slightly less than the first diameter.

In similar fashion, the second edge surfaces 30 define a second ring airfoil engaging surface 38 having a second diameter sized such that each second edge surface 30 engages a second ring airfoil 40 (FIG. 2) having an inner diameter 42 approximately the same or slightly less than the second diameter. The first ring airfoil 34 and the second ring airfoil 40 may each be formed from a suitable elastomer or elastomers in a ring configuration with a desired airfoil cross-section. A suitable ring airfoil configuration is described in commonly assigned U.S. Pat. No. 6,079,398 entitled "Ring Airfoil and Launcher" the disclosure of which is expressly incorporated herein.

The arrangement of the first edge surfaces 28 and the second edge surfaces 30 permit the first and second ring airfoils 34 and 40 to be simultaneously mounted onto the chuck 14, substantially coaxially aligned thereon, and substantially simultaneously launched. Launching of the first and second ring airfoils 34 and 40 is accomplished as described above.

At an interface between each first edge surface 28 and each second edge surface 30 there may be formed a shoulder 44. The shoulders 44 formed in this manner engage a trailing edge 46 of a first ring airfoil disposed on the chuck 14. Each second edge surface may be further formed to include a tab 48. The tabs 48 of the second edge surfaces 30 engage a trailing edge 50 of a second ring airfoil 40 disposed on the chuck 14. The shoulders 44 and the tabs 48 permit the first and second ring airfoils 34 and 40 to be securely mounted on the chuck 14, and further assist in the transfer of translational energy to the respective first and second ring airfoils 34 and 40.

Figure 5:
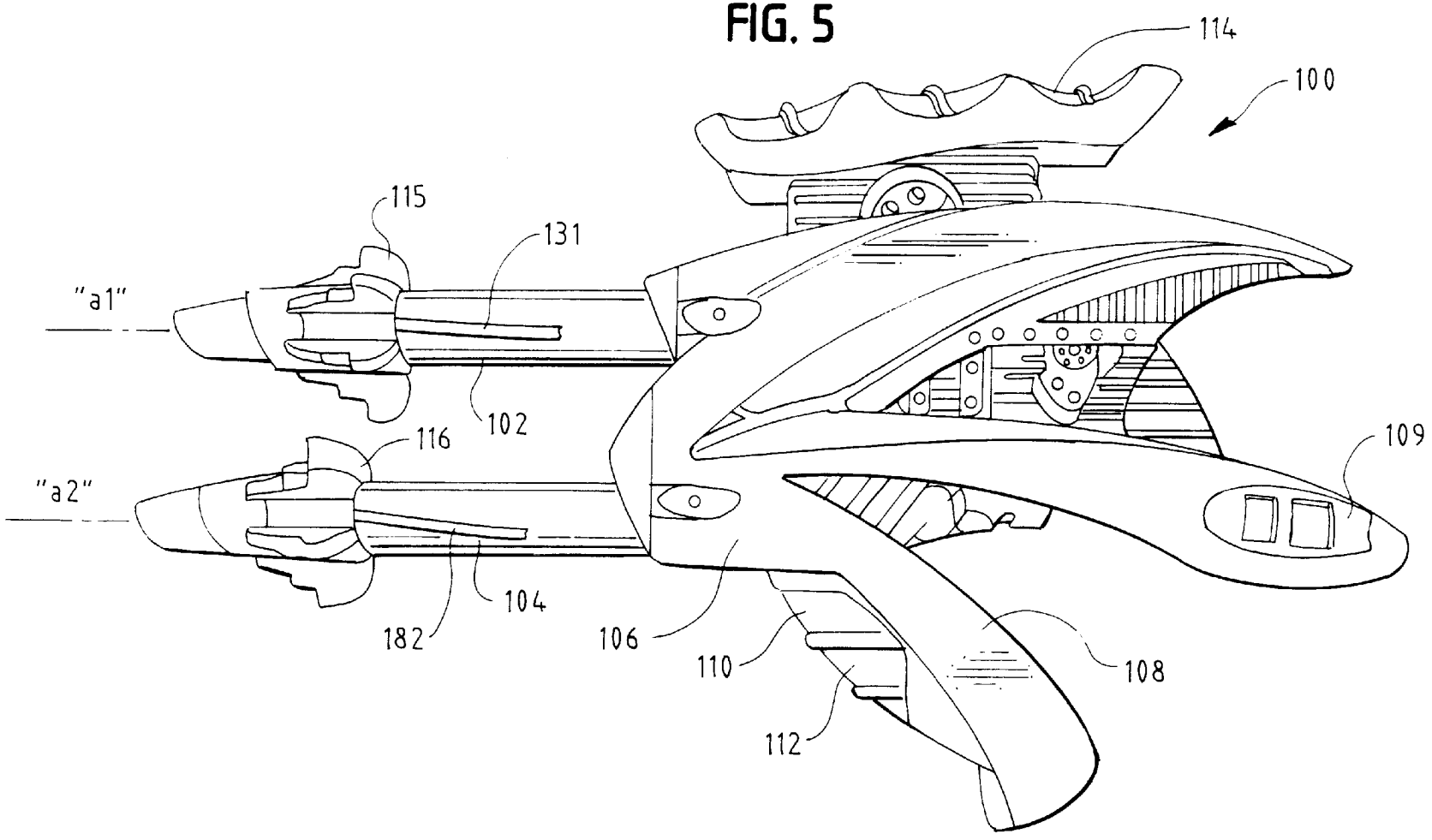
FIG. 5 is a left side view of a multiple barrel ring airfoil launcher in accordance with an alternate preferred embodiment of the invention.

With reference now to FIG. 5, a ring airfoil launcher 100 may include a first barrel 102 and a second barrel 104 extending along a first launching axis "al" and a second launching axis "a2," respectively, from a stock 106 and within a common plane. The stock 106 includes a grip 108 into which a first trigger 110 and a second trigger 112 are disposed and a butt 109. Extending from an upper portion of the stock 106 is a sight 114. The first barrel 102 and the second barrel 104 are fitted with a first chuck 115 and a second chuck 116, respectively. The first chuck 115 and the second chuck 116 may be of the construction described above with respect to the chuck 14. The ring airfoil launcher 100 may further include suitable decorative detail, and as shown, the ring airfoil launcher 100 may have a futuristic appearance.

Referring now to FIGS. 6–10, disposed within the first barrel 102 is a first launch spring 118 that is secured at a first end 120 to an end 122 of the first barrel 102. A second end 124 of the first launch spring 118 is coupled to a first end 126 of a first pull rod 128. The first pull rod 128 is coupled to the first chuck 115 (not shown in FIGS. 6–10 by a pin 130 extending through a first contoured slot 131 formed in the first barrel 102. The first contoured slot 131 may be arranged as described above with respect to the contoured slot 20 to permit axial translation of the first chuck 115 along the first barrel 102 as well as to cause rotation of the first chuck 115 as it translates along the first barrel 102 as a result of being coupled to the first pull rod 128.

The first pull rod 128 is axially slidable within the first barrel 102 and may be formed with one or more tabs (not shown) which engage one or more slots or channels (not shown) formed within the barrel 102 for guiding its axial translation.

Figure 6:
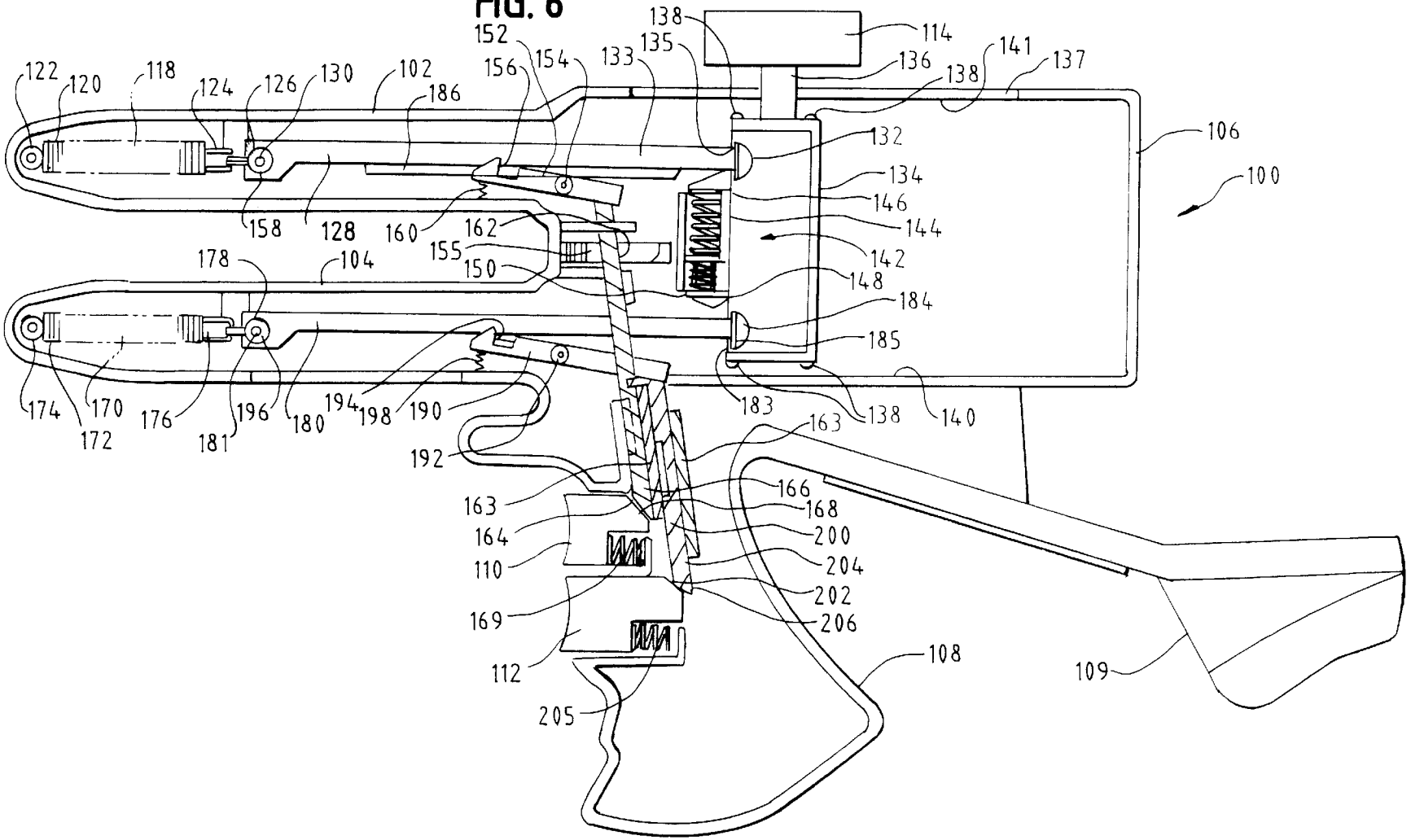
FIG. 6 is a longitudinal cross-section view of a ring airfoil launcher similar to that shown in FIG. 5.
Figure 7:
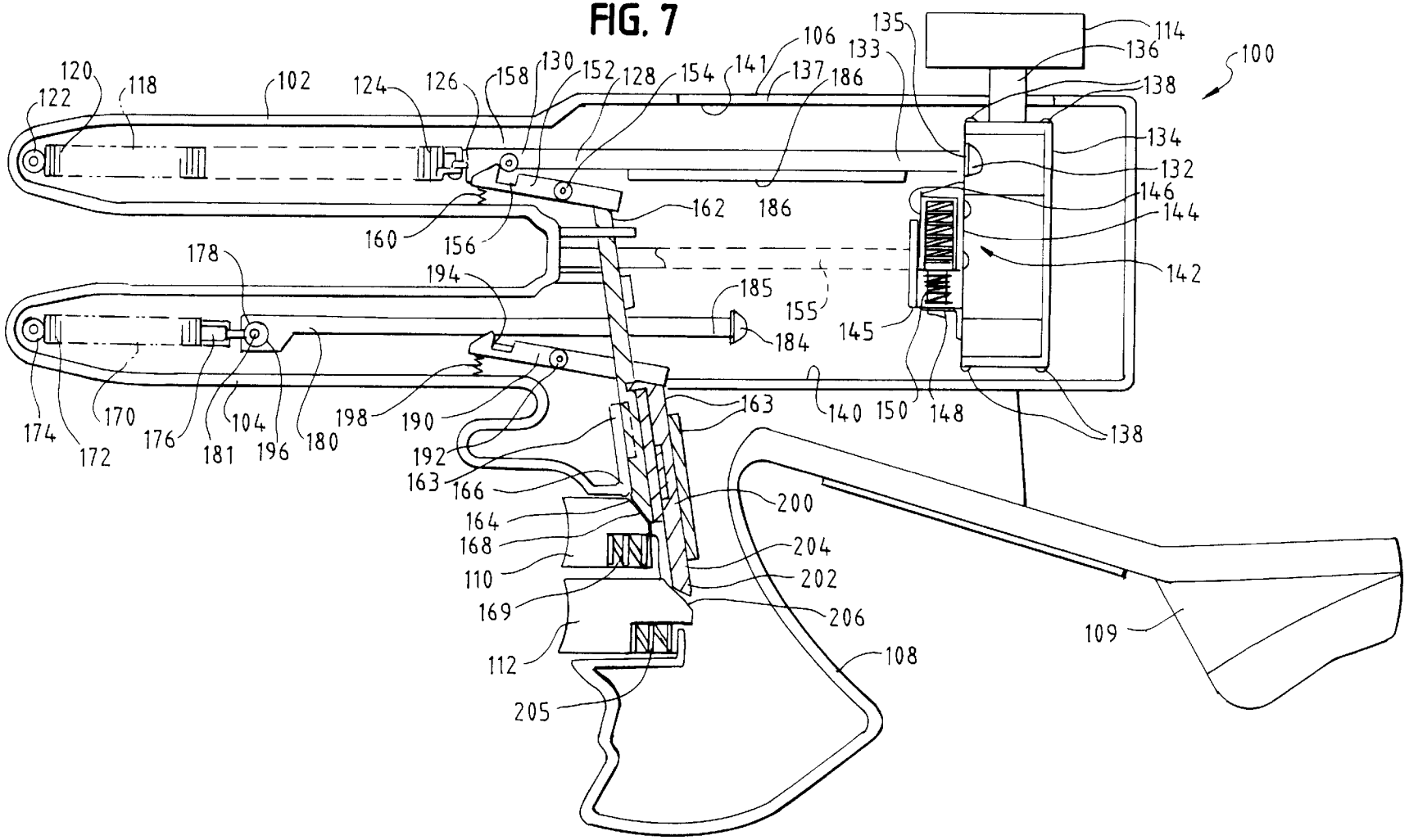
FIG. 7 is a view similar to FIG. 6 illustrating an operating state of the ring airfoil launcher shown therein.

With continued reference to FIG. 6, a button flange 132 is formed at a second end 133 of the first pull rod 128. The button flange 132 is received through an aperture 135 formed in a rack 134. The rack 134 includes a flange 136 that extends through a slot 137 formed in an upper portion of the stock 106 and is coupled by the flange 136 to the sight 114. The sight 114 is axially slidable within the slot, and the rack 134 may be supported by bearings 138 on surfaces 140 and 141 formed within the stock 106.

Adjacent the aperture 135 is a rod holder assembly 142. The rod holder assembly 142 may include a shuttle 144 retained within a shuttle housing 145 and including an upper rod holder 146 and a lower rod holder 148. A spring 150 biases the shuttle 144 in a first position wherein the upper rod holder 146 is arranged to engage the button flange 132. In operation, as the sight 114 is slid from a first position (as shown in FIG. 6) rearward with respect to the stock 106 to a second position (shown in FIG. 7), the upper rod holder 146 engages the button flange 132 and causes the upper rod 128 to axially slide within the first barrel 102 to the cocked position shown in FIG. 7.

A first latch 152 is pivotably mounted on a pin 154 secured within the stock 106. The first latch 152 includes a notch 156 that is sized to engage a boss 158 extending from the first pull rod 128 to maintain the first pull rod 128 in the cocked position wherein energy is stored in the first launch spring 118. The sight 114, and the rack 134 is then returned to the first position (FIG. 8) by a return spring 155.

The first latch 152 is biased in a latching position by a spring 160, and the first latch 152 is coupled to an actuator 162. The actuator 162 is slidable within ribs 163 formed in the stock 106 and has an angled surface 164 formed at a lower end 166 thereof. The angled surface 164 engages an angled surface 168 formed on the first trigger 110. The first trigger is supported within the stock 106 and slidable between a first position as shown in the figures and a second release position. A spring 169 bears against the first trigger 110 to bias it in the first position. When the first trigger 110 is moved to the release position by application of pressure, the angled surface 168 bears against the actuator 162 and drives it against the first latch 152. The first latch 152 is thereby caused to pivot from the latched position to an unlatched position such that the notch 156 releases the boss 158. The first pull rod 128 is caused to translate within the stock 106 by the urgency of the first launch spring 118.

Referring still to FIGS. 6–10, disposed within the second barrel 104 is a second launch spring 170 that is secured at a first end 172 to an end 174 of the second barrel 104. A second end 176 of the second launch spring 170 is coupled to a first end 178 of a second pull rod 180. The second pull rod 180 is coupled by a pin 181 to the second chuck 116, and the pin 181 extends through a second contoured slot 182 (FIG. 5) formed in the second barrel 104. The second contoured slot 182 may be arranged as described above with respect to the contoured slot to permit axial translation of the second chuck 116 along the second barrel 104 as well as to cause rotation of the second chuck 116 as it translates along the second barrel 104 as a result of being coupled to the second pull rod 180.

The second pull rod 180 is axially slidable within the second barrel 104 and may be formed with one or more tabs (not shown) which engage one or more slots or channels (not shown) formed within the second barrel 104 for guiding its axial translation. With continued reference to FIG. 6, a button flange 184 is formed at a second end 185 of the second pull rod 180. The button flange 184 is received within an aperture 183 formed in the rack 134.

Figure 8:
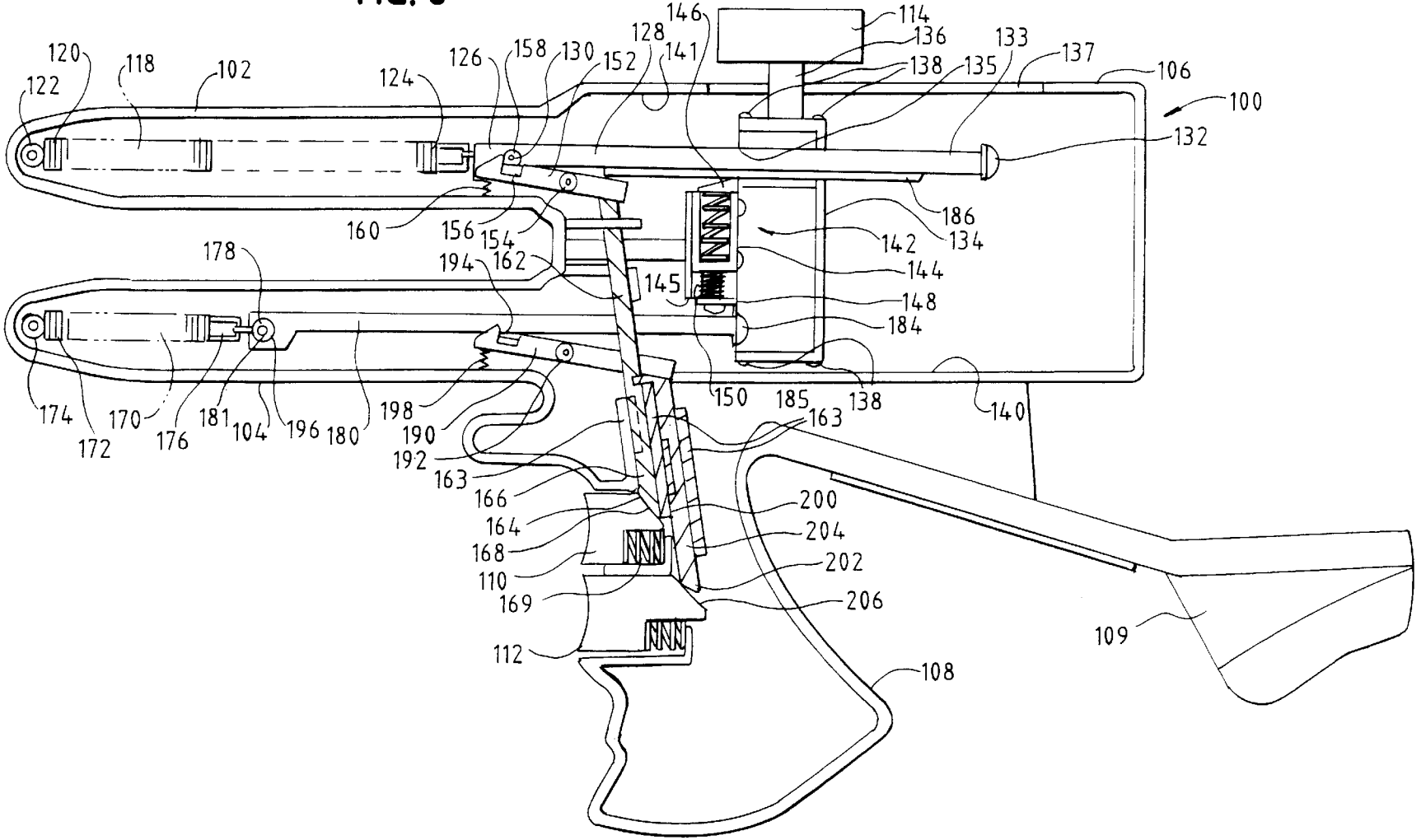
FIG. 8 is a view similar to FIG. 6 illustrating an operating state of the ring airfoil launcher shown therein.
Figure 9:
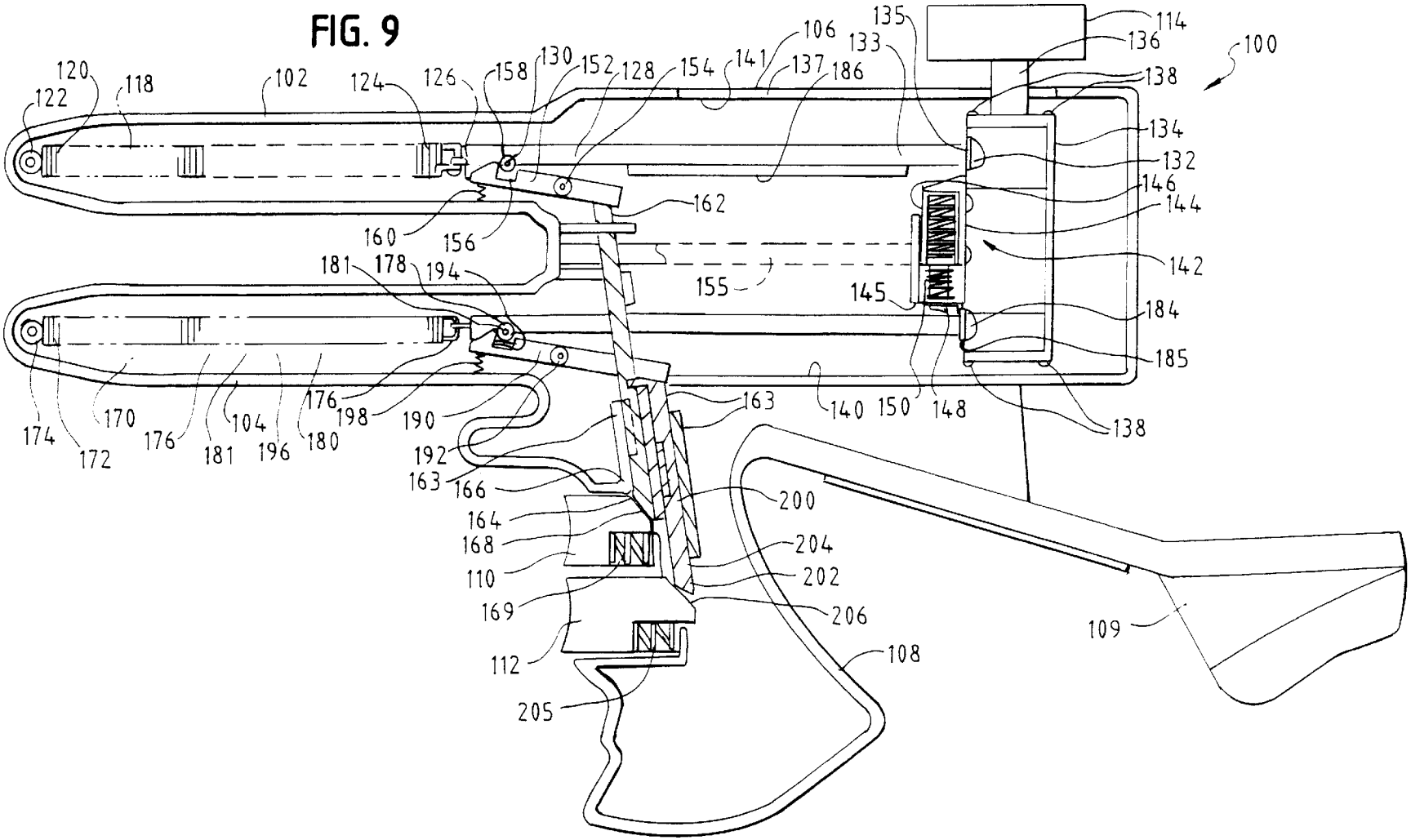
FIG. 9 is a view similar to FIG. 6 illustrating an operating state of the ring airfoil launcher shown therein.

With the first pull rod 128 in the cocked position and the rack 134 returned to the first position, a flange 186 formed on the first pull rod 128 engages the shuttle 144, and particularly the upper rod holder 146, and causes the shuttle 144 to translate against the spring 150 to a second position. In the second position, the lower rod holder 148 is arranged to engage the button flange 184. In operation, as the sight 114 is slid from the first position (as shown in FIG. 8) rearward with respect to the stock 106 to the second position (shown in FIG. 9), the lower rod holder 148 engages the button flange 184 and causes the second pull rod 180 to axially slide within the second barrel 104 to the cocked position shown in FIG. 9. The sight 114, and hence the rack 134, then returns to the first position as a result of the return spring 155 (FIG. 10).

A second latch 190 is pivotably mounted on a pin 192 secured within the stock 106. The second latch 190 includes a notch 194 that is sized to engage a boss 196 extending from the second pull rod 180 The second latch 190 is biased in a latching position by a spring 198, and the second latch 190 is coupled to an actuator 200. The actuator 200 is slidable within the ribs 163 formed within the stock 106 and has an angled surface 202 formed at a lower end 204 thereof. The angled surface 202 engages an angled surface 206 formed on the second trigger 112. The second trigger 112 is supported within the stock 106 and is biased in a first position by a spring 205 and slidable to a second, release position. In the release position, the angled surface 206 bears against the actuator 200 and drives it against the second latch 190. The second latch 190 is thereby caused to pivot from the latched position to a release position such that the notch 192 releases from the boss 196, and the second pull rod 180 is translated within the stock 106 by the urgency of the second launch spring 170.

Figure 10:
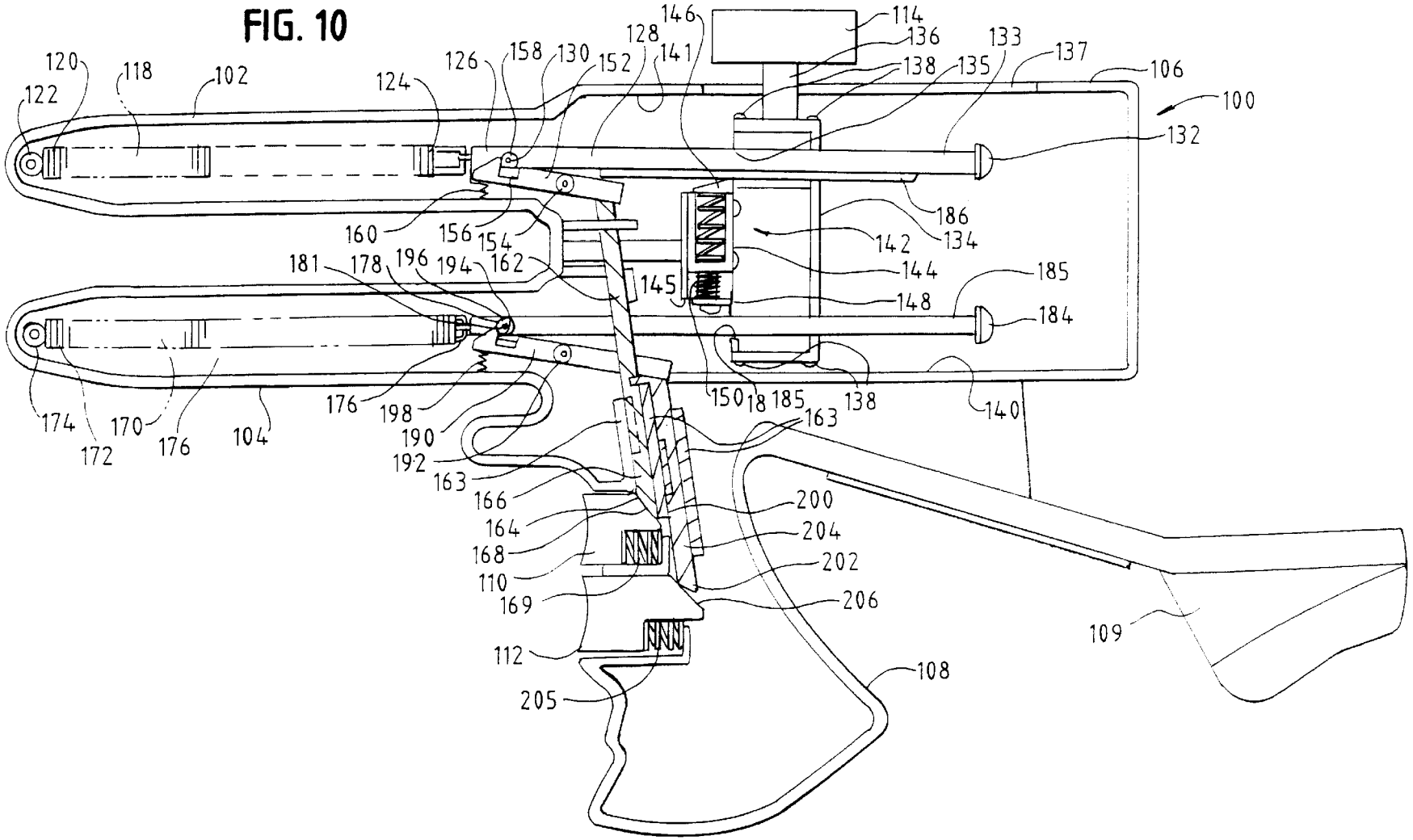
FIG. 10 is a view similar to FIG. 6 illustrating an operating state of the ring airfoil launcher shown therein.

As set out by observing FIGS. 6–10 in sequence, the cocking of both the first barrel 102 and the second barrel 104 is shown. From the position shown in FIG. 6, the sight 114 is slid rearward, as observed with respect to the stock 106, to cock the first barrel 102 as described above and as shown in FIG. 7. The sight 114 then returns to the first position as shown in FIG. 8 as result of the return spring 155. The sight 114 is then drawn rearward again to cock the second barrel 104, as described above and as shown in FIG. 9. Finally, the sight 114 is returned to the first position as shown in FIG. 10 by action of the return spring 155. Actuation of the first trigger 110 and the second trigger 112 selectively releases the respective first pull rod 128 and second pull rod 180 for launching ring airfoils from the first and second chucks 115 and 116, respectively.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A ring airfoil launcher comprising:

a barrel;

a launch spring disposed within the barrel;

a rod disposed within the barrel and coupled to the launch spring, the rod being axially slidable within the barrel between a first position and a second position, wherein in the second position energy is stored in the launch spring and in the first position energy is released from the launch spring;

a chuck, the chuck being coupled to the rod for movement therewith and the chuck being coupled to a contoured surface formed in the barrel, the contoured surface being arranged to impart a rotational motion to the chuck;

a first ring airfoil engaging surface formed on the chuck, the first ring airfoil engaging surface being adapted to engage an inner diameter of a first ring airfoil; and a second ring airfoil engaging surface formed on the chuck, the second ring airfoil engaging surface being adapted to engage an inner diameter of a second ring airfoil.

2. The ring airfoil launcher as set forth in claim 1, wherein the first ring airfoil engaging surface and the second ring airfoil engaging surface are coaxially aligned.

3. The ring airfoil launcher as set forth in claim 1, wherein the first ring airfoil engaging surface is sized to receive a first ring airfoil having a first diameter and the second ring airfoil engaging surface is sized to receive a second ring airfoil having a second diameter.

4. The ring airfoil launcher as set forth in claim 3, wherein the first diameter is smaller than the second diameter.

5. The ring airfoil launcher as set forth in claim 1, wherein the chuck comprises a hub and a plurality of ribs, the ribs being formed on the hub and extending radially outwardly from the hub, and the first ring airfoil engaging surface and the second ring airfoil engaging surface being formed on the ribs.

6. The ring airfoil launcher as set forth in claim 5, wherein each of the plurality of ribs comprises a first edge surface and a second edge surface, the first edge surface forming a portion of the first ring airfoil engaging surface and the second edge surface forming a portion of the second ring airfoil engaging surface.

7. The ring airfoil launcher as set forth in claim 6, wherein each of the plurality of ribs comprises a shoulder formed at an interface between the first edge surface and the second edge surface.

8. The ring airfoil launcher as set forth in claim 6, wherein each of the plurality of ribs comprises a tab formed adjacent the second edge surface.

9. A chuck for a ring airfoil launcher, the ring airfoil launcher having a barrel coupled to a stock and a launching mechanism disposed within the barrel and stock, the launch mechanism including a launch spring disposed within the barrel and coupled to a rod, the rod being disposed within the barrel and axially slidable therein between a first position and a second position, wherein in the second position energy is stored in the launch spring and in the first position energy is released from the launch spring, the chuck comprising:

a hub having an inner diameter sized to be received around the barrel and to be axially slidable along the barrel, the hub arranged to be coupled to the launch mechanism;

a first ring airfoil engaging surface formed on the hub, the first ring airfoil engaging surface adapted to engage an inner diameter of a first ring airfoil; and a second ring airfoil engaging surface formed on the hub, the second ring airfoil engaging surface adapted to engage an inner diameter of a second ring airfoil.

10. The chuck as set forth in claim 9, wherein the first ring airfoil engaging surface and the second ring airfoil engaging surface are coaxially aligned.

11. The chuck as set forth in claim 9, wherein the first ring airfoil engaging surface is sized to receive a first ring airfoil having a first diameter and the second ring airfoil engaging surface is sized to receive a second ring airfoil having a second diameter.

12. The chuck as set forth in claim 11, wherein the first diameter is smaller than the second diameter.

13. The chuck as set forth in claim 9, wherein the chuck comprises a plurality of ribs, the ribs being formed on the hub and extending radially outwardly from the hub, and the first ring airfoil engaging surface and the second ring airfoil engaging surface being formed on the ribs.

14. The chuck as set forth in claim 13, wherein each of the plurality of ribs comprises a first edge surface and a second edge surface, the first edge surface forming a portion of the first ring airfoil engaging surface and the second edge surface forming a portion of the second ring airfoil engaging surface.

15. The chuck as set forth in claim 14, wherein each of the plurality of ribs comprises a shoulder formed at an interface between the first edge surface and the second edge surface.

16. The chuck as set forth in claim 14, wherein each of the plurality of ribs comprises a tab formed adjacent the second edge surface.

17. A ring airfoil launcher comprising:

a first barrel;

a first launch spring disposed within the first barrel;

a first rod disposed within the first barrel and coupled to the first launch spring, the first rod being axially slidable within the first barrel between a first position and a second position, wherein in the second position energy is stored in the first launch spring and in the first position energy is released from the first launch spring;

a first latch arranged to engage the first rod to retain the first rod in the second position in order to retain the energy in the first launch spring;

a first trigger coupled to the first latch to release the first latch from the first rod such that the energy is released from the first launch spring and into the first rod such that the first rod is translated within the first barrel from the second position to the first position;

a first chuck, the first chuck being coupled to the first rod for movement therewith and the first chuck being coupled to a first contoured surface formed in the first barrel, the first contoured surface arranged to impart a rotational motion to the first chuck;

a first ring airfoil engaging surface formed on the first chuck, the first ring airfoil engaging surface adapted to receive a first ring airfoil;

a second barrel;

a second launch spring disposed within the second barrel;

a second rod disposed within the second barrel and coupled to the second launch spring, the second rod being axially slidable within the second barrel between a first position and a second position, wherein in the second position energy is stored in the second launch spring and in the first position energy is released from the second launch spring;

a second latch arranged to engage the second rod to retain the second rod in the second position in order to retain the energy in the second launch spring;

a second trigger coupled to the second latch to release the second latch from the second rod such that the energy is released from the second launch spring and into the second rod such that the second rod is translated within the second barrel from the second position to the first position;

a second chuck, the second chuck being coupled to the second rod for movement therewith and the second chuck being coupled to a second contoured surface formed in the second barrel, the second contoured surface arranged to impart a rotational motion to the second chuck; and a second ring airfoil engaging surface formed on the second chuck, the second ring airfoil engaging surface adapted to receive a second ring airfoil.

18. The ring airfoil launcher as set forth in claim 17, wherein the first barrel and the second barrel are disposed within a plane.

19. The ring airfoil launcher as set forth in claim 17, wherein the first chuck comprises a third ring airfoil engaging surface and the second chuck comprises a fourth ring airfoil engaging surface.

20. The ring airfoil launcher as set forth in claim 17, further comprising a rack having a first position and a second position, the rack comprising a shuttle formed with a first rod holder and a second rod holder, the shuttle being biased in the first position by a spring such that first rod holder engages the first rod, and the shuttle being moveable to the second position wherein the second rod holder engages the second rod.

21. A ring airfoil launcher comprising:

a first barrel;

a first launch spring disposed within the first barrel;

a first rod disposed within the first barrel and coupled to the first launch spring, the first rod being axially slidable within the first barrel between a first position and a second position, wherein in the second position energy is stored in the first launch spring and in the first position energy is released from the first launch spring;

a first latch arranged to engage the first rod to retain the first rod in the second position in order to retain the energy in the first launch spring;

a first trigger coupled to the first latch to release the first latch from the first rod such that the energy is released from the first launch spring and into the first rod such that the first rod is translated within the first barrel from the second position to the first position;

a first chuck, the first chuck being coupled to the first rod for movement therewith and the first chuck being coupled to a first contoured surface formed in the first barrel, the first contoured surface arranged to impart a rotational motion to the first chuck;

a first ring airfoil engaging surface formed on the first chuck, the first ring airfoil engaging surface adapted to receive a first ring airfoil and a second ring airfoil engaging surface formed on the first chuck, the second ring airfoil engaging surface adapted to receive a second ring airfoil;

the first chuck including a first hub and a plurality of ribs, the ribs being formed on the first hub and extending radially outwardly from the first hub wherein each of the plurality of ribs comprises a first edge surface and a second edge surface, the first edge surface forming a portion of the first ring airfoil engaging surface and the second edge surface forming a portion of the second ring airfoil engaging surface;

a second barrel;

a second launch spring disposed within the second barrel;

a second rod disposed within the second barrel and coupled to the second launch spring, the second rod being axially slidable within the second barrel between a first position and a second position, wherein in the second position energy is stored in the second launch spring and in the first position energy is released from the second launch spring;

a second latch arranged to engage the second rod to retain the second rod in the second position in order to retain the energy in the second launch spring;

a second trigger coupled to the second latch to release the second latch from the second rod such that the energy is released from the second launch spring and into the second rod such that the second rod is translated within the second barrel from the second position to the first position;

a second chuck, the second chuck being coupled to the second rod for movement therewith and the second chuck being coupled to a second contoured surface formed in the second barrel, the second contoured surface arranged to impart a rotational motion to the second chuck;

a third ring airfoil engaging surface formed on the second chuck, the third ring airfoil engaging surface adapted to receive a third ring airfoil and a fourth ring airfoil engaging surface formed on the second chuck, the fourth ring airfoil engaging surface adapted to receive a fourth ring airfoil; and the second chuck including a second hub and a plurality of ribs, the plurality of ribs being formed on the second hub and extending radially outwardly from the second hub wherein each of the plurality of ribs comprises a third edge surface and a fourth edge surface, the third edge surface forming a portion of the third ring airfoil engaging surface and the fourth edge surface forming a portion of the fourth ring airfoil engaging surface.

* * * * *